US005141675A

United States Patent [19]

Vanderpool et al.

[11] Patent Number: 5,141,675

[45] Date of Patent: Aug. 25, 1992

[54] NOVEL POLYPHOSPHATE/AZOLE COMPOSITIONS AND THE USE THEREOF AS COPPER AND COPPER ALLOY CORROSION INHIBITORS

[75] Inventors: Daniel P. Vanderpool; Susan P. Rey, both of Coraopolis, Pa.

[73] Assignee: Calgon Corporation, Pittsburgh, Pa.

[21] Appl. No.: 597,634

[22] Filed: Oct. 15, 1990

[51] Int. Cl.[5] ..... C23F 11/14; C23F 11/16

[52] U.S. Cl. ..... 252/389.23; 252/389.61; 252/389.62; 252/394; 252/395; 422/15; 422/16

[58] Field of Search ..... 252/394, 395, 389.23, 252/389.62, 389.61; 210/699; 422/15, 16

[56] References Cited

U.S. PATENT DOCUMENTS

| | | | |
|---|---|---|---|
| 3,413,227 | 11/1968 | Howard et al. | 252/392 X |
| 3,502,587 | 3/1970 | Stanford et al. | 210/699 |
| 3,751,372 | 8/1973 | Zecher | 210/699 |
| 3,791,855 | 2/1974 | Korpics | 252/394 |
| 3,803,049 | 4/1974 | Korpics | 252/394 |
| 3,852,213 | 12/1974 | Cooney | 210/698 |
| 3,985,503 | 10/1976 | O'Neal, Jr. | 210/394 |
| 4,172,032 | 10/1979 | Farley | 210/699 |
| 4,338,209 | 7/1982 | Manabe et al. | 252/389.2 X |
| 4,406,811 | 5/1988 | Christensen et al. | 252/389.22 |
| 4,675,158 | 6/1987 | Klindera | 422/36 |
| 4,744,950 | 5/1988 | Hollander | 422/16 |
| 4,873,139 | 10/1989 | Kinosky | 428/341 |

FOREIGN PATENT DOCUMENTS 0173427 6/1985 European Pat. Off. .

OTHER PUBLICATIONS

Chemical Abstract 47253(m) vol. 95.
Ser. Nos. 348532 and 348521.

*Primary Examiner*—Deborah L. Kyle
*Assistant Examiner*—Valerie Fee
*Attorney, Agent, or Firm*—W. C. Mitchell; C. M. Caruso

[57] ABSTRACT

A polyphosphate in combination with an azole such as in alkyl or alkoxy benzotriazole, mercaptobenzothiazole, tolyltriazole, benzotriazole, a substituted benzotriazole and/or 1-phenyl-5-mercaptotetrazole, is used to inhibit the corrosion of metallic surfaces, particularly copper surfaces, in contact with an aqueous system. Systems and compositions are also claimed.

10 Claims, No Drawings

NOVEL POLYPHOSPHATE/AZOLE COMPOSITIONS AND THE USE THEREOF AS COPPER AND COPPER ALLOY CORROSION INHIBITORS

BACKGROUND OF THE INVENTION

Benzotriazole, mercaptobenzothiazole and tolyltriazole are well known copper corrosion inhibitors. For example, see U.S. Pat. No. 4,675,158 and the references cited therein. This patent discloses the use of tolyltriazole/mercaptobenzothiazole compositions as copper corrosion inhibitors. Also, see U.S. Pat. No. 4,744,950, which discloses the use of lower ($C_3$–$C_6$) alkylbenzotriazoles as corrosion inhibitors, and corresponding EPO application No. 85304467.5.

U.S. Pat. No. 4,338,209 discloses metal corrosion inhibitors which contain one or more of mercaptobenzothiazole, tolyltriazole and benzotriazole. Examples of formulations containing benzotriazole and tolyltriazole and formulations containing mercaptobenzothiazole and benzotriazole are given.

Copending patent application U.S. Ser. No. 348,521 relates to the use of higher alkylbenzotriazoles as copper and copper alloy corrosion inhibitors, copending patent application U.S. Ser. No. 348,532 relates to the use of alkoxybenzotriazoles as copper and copper alloy corrosion inhibitors, and copending patent application U.S. Ser. No. 540,977 relates to the use of alkylbenzotriazole/mercaptobenzothiazole, tolyltriazole, benzotriazole and/or phenyl mercaptotetrazole compositions as copper and copper alloy corrosion inhibitors.

U.S. Pat. No. 4,406,811 discloses compositions containing a triazole such as tolyltriazole, benzotriazole or mercaptobenzothiazole, an aliphatic mono- or di-carboxylic acid and a nonionic wetting agent.

U.S. Pat. No. 4,363,913 discloses a process for preparing 2-aminobenzothiazoles and alkyl and alkoxy-substituted aminobenzothiazoles.

U.S. Pat. No. 2,861,078 discloses a process for preparing alkyl and alkoxy-substituted benzotriazoles.

U S. Pat. No. 4,873,139 discloses the use of 1-phenyl-1H-tetrazole-5-thiol to prepare corrosion-resistant silver and copper surfaces. The use of 1-phenyl-5-mercaptotetrazole to inhibit the corrosion of carbon steel in nitric acid solutions is also known. See Chemical Abstract CA 95(6):47253 (1979).

U.S. Pat. No. 4,014,814 discloses corrosion inhibiting compositions comprising phenyl-aldehyde resins and polyphosphates.

The present invention relates to corrosion inhibiting compositions comprising a) a polyphosphate; and b) an azole, preferably a compound selected from the group consisting of $C_2$–$C_{12}$ alkyl or alkoxy benzotriazoles, mercaptobenzothiazole, tolyltriazole, benzotriazole, substituted benzotriazoles such as chlorobenzotriazole, nitrobenzotriazole, etc. and 1-phenyl-5-mercaptotetrazole, and salts thereof and the use thereof as corrosion inhibitors, particularly copper and copper alloy corrosion inhibitors. In these compositions the polyphosphate component is believed to assist adsorption of the inhibitor component, thereby improving inhibition on the metal surface being treated. The instant compositions are especially effective in the treatment of copper and copper alloy surfaces, particularly copper/nickel alloy surfaces Additionally, these compositions generally provide improved tolerance to oxidizing biocides such as chlorine and bromine.

The use of the instant blends of a) polyphosphates and b) an azole, preferably at least one of $C_2$–$C_{12}$ alkyl-or alkoxybenzotriazoles, tolyltriazole, benzotriazole and 1-phenyl-5-mercaptotetrazole or related compounds provides substantial corrosion inhibition, even in aggressive waters. It is theorized that the corrosion inhibition provided by azoles is due to the formation of a cuprous/azole complex. Cupric (Cu(II)) azoles are not believed to be protective, and can even be detrimental if their presence results in the formation of Cu(II) azole nodules on the surface of the metal being treated. Therefore, it is theorized, compounds which can remove or slow the formation of the cupric oxide corrosion film will assist the penetration of the azole to the cuprous oxide layer by preventing the undesirable buildup of the Cu(II) azole complex at the surface. It is believed, though the inventors do not wish to be bound by this mechanism, that the instant compositions help to reduce the undesirable deposition of cupric oxides on metallic surfaces, thereby allowing the azole better access to the cuprous oxide surface. Thus, the instant compositions provide effective film formation, provide chemically resistent corrosion protection and overcome problems relating to the failure to obtain passivation due to Cu(II) azole complexes, particularly in aggressive, high-solids waters.

As used herein the term "passivation" refers to the formation of a film which lowers the corrosion rate of the metallic surface which is being treated. "Passivation rate" refers to the time required to form a protective film on a metallic surface. Also, the term "high solids water" refers to water which contains dissolved solids in excess of about 1,500 mg/L. Dissolved solids include, but are not limited to, anions released from chlorides, sulfates, silicates, carbonates, bicarbonates and bromides; and cations such as lithium, sodium, potassium, calcium and magnesium.

The instant polyphosphate/azole compositions, or the use thereof for corrosion control, are not known or suggested in the art.

DESCRIPTION OF THE INVENTION

In its broadest sense, the instant invention is directed to compositions which comprise a) a polyphosphate and b) an azole, preferably an azole selected from the group consisting of $C_2$–$C_{12}$ alkyl or alkoxybenzotriazoles and salts thereof, tolyltriazole and salts thereof, benzotriazole and salts thereof, substituted benzotriazoles and salts thereof, mercaptobenzothiazole and salts thereof and phenyl mercaptobenzothiazole and its isomers and salts thereof. More particularly, the instant invention is directed to compositions comprising: a) a polyphosphate and b) a compound selected for the group consisting of $C_2$–$C_{12}$ alkyl or alkoxybenzotriazoles, mercaptobenzothiazole, tolyltriazole, benzotriazole, substituted benzotriazoles including, but not limited to, chlorobenzotriazole and nitrobenzotriazole, 1-phenyl-5-mercaptotetrazole, isomers of phenyl mercaptotetrazole and salts of the above compounds, wherein the weight ratio of a):b), on an active basis, ranges from about 50:1 to about 1:50, preferably about 5:1 to about 1:5. The instant invention is also directed to a method for inhibiting the corrosion of metallic surfaces, particularly copper and copper alloy surfaces and most particularly copper/-nickel alloys, in contact with an aqueous system, comprising adding to the aqueous system being treated an effective amount of at least one of the above described polyphosphate/azole compositions.

The instant invention is also directed to an aqueous system which is in contact with a metallic surface, particularly a copper or copper alloy surface, and most particularly a copper/nickel alloy surface, which contains an effective amount of at least one of the instant polyphosphate/azole compositions.

Compositions comprising water, particularly cooling water, and the instant polyphosphate/azole compositions are also claimed.

The inventors have discovered that the instant polyphosphate/azole compositions are effective corrosion inhibitors, particularly with respect to copper and copper-containing metals, especially copper/nickel alloys. Since the instant compositions of this invention are especially effective inhibitors of copper and copper alloy corrosion, they can be used to protect multimetal systems, especially those containing copper and nickel.

The instant inventors have also found that the instant compositions de-activate soluble copper ions, which prevents the galvanic deposition of copper which concomminantly occurs with the galvanic dissolution of iron or aluminum in the presence of copper ions. This reduces aluminum and iron corrosion. These compositions also indirectly limit the above galvanic reaction by preventing the formation of soluble copper ions due to the corrosion of copper and copper alloys.

Any polyphosphate can be used as component a). The preferred polyphosphates are selected from the group consisting of inorganic polyphosphates and phosphorylated polyols. More particularly, polyphosphates used in the practice of this invention are selected from the group consisting of:

1. inorganic polyphosphates having a molar ratio of at least one of alkali metal oxide, alkaline earth metal oxide or zinc oxide to $PO_3$ of about $$\frac{0.4}{1} - \frac{2}{1}$$

and their corresponding acids having a molar ratio of water to $PO_3$ of about $$\frac{0.4}{1} - \frac{2}{1}.$$

and 2. polyfunctional acid phosphate esters of polyhydric alcohol, said esters having the formula $R—(O—PO_3H_2)_x$ wherein R is any remaining organic residue of a polyhydric alcohol used as the starting material and x is a number from 2–6, said esters being referred to in this specification including claims as phosphorylated polyols.

Illustrative examples of polyhydric alcohols are glycerol, polyglycerol (dimer, trimer, tetramer, etc.), pentaerythritol, dipentaerythritol, 2.5-hexanediol, 1,2,6-hexanetriol, polyvinyl alcohols whose 4% aqueous solutions are in the viscosity range of 2 to 25 centipoises, trimethylolethane, trimethylolpropane, 1:2-propanediol, ethylene glycol, diethylene glycol, sucrose and low molecular weight phenolic novolaks.

Application water-soluble inorganic polyphosphates include, for instance, any of the water-soluble glassy and crystalline phosphates, e.g., the so-called molecularly dehydrated phosphates of any of the alkali metals, alkaline earth metals, and zinc, as well as zinc-alkali metal polyphosphates and mixtures thereof. Included also are the acids corresponding to these polyphosphate salts, e.g., pyrophosphoric acid ($H_4P_7O_7$) and higher phosphoric acids having a molar ratio of water to $P_2O_5$ of about $$\frac{0.4}{1} - \frac{2}{1}.$$

Illustrative examples of inorganic polyphosphates include the pyrophosphates, such as tetrapotassium pyrophosphate and pyrophosphoric acid, polyphosphoric acid and mixtures with ortho-phosphate, wherein the ratio of o—$PO_4$ to polyphosphate may vary from about 1 to 100 to about 100 to 1, most preferably from about 1:10 to 10:1.

Phosphorylated polyols of the type used in this invention are disclosed in U.S. Pat. No. 3,580,855. Also, see U.S. Pat. No. 4,301,025, which relates to partial esters of polyphosphoric acids. A number of processes are known in the art for preparing the phosphorylated polyols. A preferred process is to react polyphosphoric acid with a polyol. The polyphosphoric acid should have a $P_2O_5$ content of at least about 72%, preferably about 82 to 84%. A residue of orthophosphoric acid and polyphosphoric acid remains on completion of the reaction. This residue may be as high as about 25–40% of the total weight of the phosphorylated polyol. It may either be removed or left in admixture with the phosphorylated polyol. Preferably the phosphorylated polyols produced by this process are prepared employing amounts of a polyphosphoric acid having about 0.5–1 molar equivalents of $P_2O_5$ for each equivalent of the polyol used. Larger amounts of polyphosphoric acid can be used if desired. By "equivalents of the polyol" is meant the hydroxyl equivalents of the polyol. For example one mole of glycerol is three equivalents thereof, one mole of pentaerythritol is four equivalents thereof, and so forth. The phosphorylated polyols can be partially or completely converted to their corresponding alkali metal salts or ammonium salts by reacting the phosphorylated polyols with appropriate amounts of alkali metal hydroxides or ammonium hydroxides.

Any azole can be used as component (b). For example any alkyl or alkoxybenzotriazole compound having the following structure can be used:

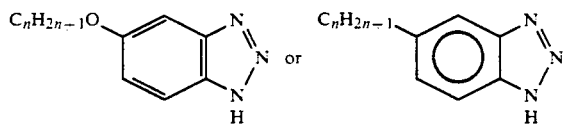

wherein n is greater than or equal to 2 or less than or equal to 12. Salts of such compounds may also be used.

Isomers of the above described alkyl or alkoxybenzotriazoles can also be used as component b). The 5 and 6 isomers are interchangeable by a simple prototropic shift of the 1 position hydrogen to the 3 position and are believed to be functionally equivalent. The 4 and 7 isomers are believed to function as well as or better than the 5 or 6 isomers, though they are generally more difficult and expensive to manufacture. As used herein, the term "alkyl or alkoxybenzotriazoles" is intended to mean 5-alkyl or alkoxy benzotriazoles and 4,6, and 7 position isomers thereof, wherein the alkyl chain length is greater than or equal to 2 but less than or equal to 12 carbons, branched or straight, preferably straight. Compositions containing straight chain alkyl or alkoxybenzotriazoles are believed to provide more persistent films in the presence of chlorine.

The preferred alkyl or alkoxybenzotriazoles are sodium salts of $C_5$–$C_8$ alkyl or alkoxybenzotriazoles.

Further examples of component b) of the instant compositions include compounds selected from the group consisting of mercaptobenzothiazole (MBT) and salts thereof, preferably sodium and potassium salts of BT, preferably sodium and potassium salts of MBT, tolyltriazole (TT) and salts thereof, preferably sodium and potassium salts of TT, benzotriazole (BT) and salts thereof, substituted benzotriazoles, such as chlorobenzotriazole and nitrobenzotriazole, and salts thereof, preferably sodium and potassium salts thereof, 1-phenyl-5-mercaptotetrazole (PMT), isomers of PMT, including tautomeric isomers such as 1-phenyl-5-tetrazolinthione and positional isomers such as 2-phenyl-5-mercaptotetrazole and its tautomers, substituted phenyl mercaptotetrazoles, wherein phenyl is $C_1$–$C_{12}$ (straight or branched) alkyl-, $C_1$–$C_{12}$ (straight or branched) alkoxy-, nitro-, halide-, sulfonamido- or carboxyamido substituted, and salts of the above mercaptotetrazoles, preferably the sodium salt. TT and MBT or salts thereof are preferred, and TT is most preferred. The ratio, by weight, of component a):b) should range from about 50:1 to about 50, preferably from about 10:1 to about 1:10, and most preferably from about 5:1 to about 1:5.

An effective amount of one of the instant polyphosphate/azole compositions should be used. As used herein, the term "effective amount" relative to the instant compositions refers to that amount of an instant composition, on an active basis, which effectively inhibits metal corrosion to the desired degree in a given aqueous system. Preferably, the instant compositions are added at an active concentration of at least 0.1 ppm, more preferably about 0.1 to about 500 ppm, and most preferably about 0.5 to about 100 ppm, based on the total weight of the water in the aqueous system being treated. Of course, the total amount of the corrosion inhibition composition of this invention employed in a particular water system is dependent upon the corrosiveness of the system being treated, which in turn is dependent upon many factors such as temperature, pH, flow rate, hardness and dissolved solids.

Maximum concentrations of the instant compositions are determined by the economic considerations of the particular application. The maximum economic concentration will generally be determined by the cost of alternative treatments of comparable effectiveness, if comparable treatments are available. Cost factors include, but are not limited to, the total through-put of system being treated, the costs of treating or disposing of the discharge, inventory costs, feed-equipment costs, and monitoring costs. On the other hand, minimum concentrations are determined by operating conditions such as pH, dissolved solids and temperature.

The instant compositions comprising at least one copper corrosion inhibiting azole selected from the group consisting of tolyltriazole, benzotriazole substituted benzotriazoles, phenyl mercaptotetrazoles, substituted phenyl mercaptotetrazoles, mercaptobenzothiazole, salts thereof, and alkyl or alkoxybenzotriazole and salts thereof, and a polyphosphate can be used in virtually any aqueous system which is in contact with a metallic surface, particularly in copper-containing surface. The instant inventors have discovered that the performance of corrosion inhibiting compounds such as TT, BT, substituted benzotriazoles MBT, PMT, phenyl-substituted PMT, alkyl or alkoxybenzotriazoles and salts thereof is generally enhanced by the presence of small quantities of a polyphosphate. Thus, an effective amount for the purpose of improving the efficacy of an azole corrosion inhibitor of a polyphosphate generally improves the efficacy of conventional copper corrosion inhibitors. While virtually any amount of a polyphosphate helps, the preferred amount is at least about 1 part polyphosphate per 50 parts corrosion inhibitor, on an active basis. More preferably, the weight ratio of polyphosphate:corrosion inhibitor should be at least 1.5.

A preferred polyphosphate for use in the invention is an equilibrium admixture of orthophosphoric acid, pyrophosphoric acid and higher linear polyphosphoric acid which is commercially available from FMC Corporation. The most preferred polyphosphates are polyphosphoric acid esters, particularly esters of polyhydroxy alcohols, such as glycol esters. These esters are commercially available from Calgon Corporation as Conductor 5712.

A composition which is exemplary of the best mode comprises Conductor 5712 and the sodium salt of tolyltriazole, wherein the weight ratio of these components is about 4:1. This composition would then be added in an amount effective to achieve the desired corrosion inhibition for a given system to be treated, and is especially effective in treating copper/nickel alloys. The actual dosage would depend upon the chemistry of the system to be treated, the treatment specification, the type of metal to be protected and other factors. One skilled in the art would easily be able to determine the optimal dosage for a given system.

The alkyl or alkoxybenzotriazoles of component b) may be prepared by any known method. For example, the instant alkoxybenzotriazoles may be prepared by contacting a 4-alkoxy-1, 2-diaminobenzene with an aqueous solution of sodium nitrite in the presence of an acid, e.g., sulfuric acid, and then separating the resultant oily product from the aqueous solution. The 4-alkoxy-2-diaminobenzene may be obtained from any number of sources. Also, see U.S. Pat. No. 2,861,078, which discusses the synthesis of alkoxybenzotriazoles.

Also, several compounds which may be used as component (b) are commercially available. For example, tolyltriazole and benzotriazole are commercially available from PMC, Inc. MBT is commercially available from 1) Uniroyal Chemical Co., Inc. or 2) Monsanto, and PMT is commercially available from 1) Fairmount Chemical Co., Inc., 2) Aceto Corporation and 3) Triple Crown America, Inc. Generally, TT and MBT are sold as sodium salts.

The instant compositions may be prepared by simply blending the constituent compounds. Suitable preparation techniques are well known in the art of 5 water treatment and by suppliers of triazoles. For example, aqueous solutions may be made by blending the solid ingredients into water containing an alkali salt like sodium hydroxide or potassium hydroxide; solid mixtures may be made by blending the powders by standard means; and organic solutions may be made by dissolving the solid inhibitors in appropriate organic solvents. Alcohols, glycols, ketones and aromatics, among others, represent classes of appropriate solvents.

The instant method may be practiced by adding the constituent compounds simultaneously (as a single composition), or by adding them separately, whichever is more convenient. Suitable methods of addition are well known in the art of water treatment.

The instant compositions can be used as water treatment additives for industrial cooling water systems, gas scrubber systems or any water system which is in contact with a metallic surface, particularly surfaces containing copper and/or copper alloys. They can be fed alone or as part of a treatment package which includes, but is not limited to, biocides, scale inhibitors, dispersants, defoamers and other corrosion inhibitors. Preferred scale inhibitors include, but are not limited to, low molecular weight polyacrylates and polymer comprising a carboxylic acid and a sulfonic acid, such as TRC-233, which is commercially available from Calgon Corporation. Also, the instant polyphosphate/azole compositions can be fed intermittently or continuously.

Treatment of cooling water which contacts copper or copper alloy surfaces, such as admiralty brass or 90/10 copper-nickel, requires the use of specific copper inhibitors. These inhibitors: 1. reduce the corrosion of the copper or copper alloy surfaces, including general corrosion, dealloying and galvanic corrosion; and 2. reduce problems of galvanic "plating-out" of soluble copper ions onto iron or aluminum. Thus, soluble copper ions can enhance the corrosion of iron and/or aluminum components in contact with aqueous systems. This occurs through the reduction of copper ions by iron or aluminum metal, which is concommitantly oxidized, resulting in the "plating-out" of copper metal onto the iron surface. This chemical reaction not only destroys the iron or aluminum protective film but creates local galvanic cells which can cause pitting corrosion of iron or aluminum.

While conventional copper inhibitors such as tolyltriazole, benzotriazole, and mercaptobenzothiazole, which are used in the instant compositions, are commonly used alone as copper inhibitors in aqueous systems, they are generally fed continuously because of the limited durability of their protective films.

The requirement for continuous feed generally makes it uneconomical to apply these conventional inhibitors to once-through systems or systems with high blowdown rates. Additionally, conventional inhibitors provide only limited protection against chlorine induced corrosion.

These deficiencies are generally overcome by the instant compositions. It is therefore an object of the instant invention to provide inhibitors which produce more chlorine resistant protective films, and which are effective in high-solids, particularly high dissolved solids, aggressive waters.

These and other objects are achieved through the use of the instant polyphosphate/alkyl or alkoxybenzotriazole, TT,BT,MBT or PMT compositions, which quickly provide protective, durable films on metallic surfaces, especially copper and copper alloy surfaces. These compositions are especially effective in the presence of oxidizing biocides such as chlorine and bromine biocides and/or high solids, and in the treatment of copper nickel alloys.

Further, the instant compositions allow the use of an intermittent feed to cooling water systems. Depending on water aggressiveness, the time between feedings may range from several days to months. This results in an average lower inhibitor requirement and provides advantages relative to waste treatment and environmental impact.

EXAMPLES

The following examples demonstrate the effectiveness of the instant compositions as copper and copper alloy corrosion inhibitors. They are not, however, intended to limit the scope of the invention in any way.

EXAMPLE 1-4

The corrosion rates of 90/10 copper/nickel electrodes were measured by linear polarization using Petrolite M1010 equipment (also referred to as the PAIR method). Specimens were immersed in an 8L vessel fitted with a heater/circulator, pH controller to maintain pH @7.8±0.2, an aerator to saturate the water with air. The following table summarizes the results.

| Inhibitor dosage (ppm) | Corrosion Rate mpy after 18 hrs[1] | Appearance |
|---|---|---|
| 1) 0 TT[2] 0 Conductor 5712 | 0.5 | General Tarnish |
| 2) 6 TT | 1.6 | Localized Green Nodules, and General Green Deposits |
| 3) 100 Conductor 5712 | 0.5 | General Tarnish |
| 4) 6 TT Plus 100 Conductor 5712 | 0.04 | Bright Metallic Appearance. Like New. |

[1]Water Composition: 3 ppm $PO_2^{-2}$, 260 ppm $K^-$, 9500 ppm $SO_4$, 5000 ppm $Cl^-$, 180 ppm $Mg^{-2}$, 18 ppm $F^-$, 130 ppm $SiO_2$ and 260 ppm $Ca^{-2}$.
[2]TT is a tolyltriazole, sodium salt. Conductor 5712 is commercially available from Calgon Corporation

What is claimed is:

1. A method for inhibiting corrosion of a copper/nickel alloy which is in contact with an aqueous system comprising adding to said aqueous system an effective amount of a composition comprising: a) a polyphosphate selected from the group consisting of phosphate esters of polyhydric alcohols, wherein said esters are of the formula $R—(O—PO_3H_2)_x$, and wherein R is any remaining organic residue of said polyhydric alcohols and X is 2-6; and b) an azole selected from the group consisting of $C_2$-$C_{12}$ alkyl or alkoxybenzotriazoles, tolyltriazole, benzotriazole, mercaptobenzothiazole, 1-phenyl-5-mercaptotetrazole, isomers of 1-phenyl-5-mercaptotetrazole, and salts thereof wherein the weight ratio of a):b) ranges from about 50:1 to about 1:50.

2. The method of claim 1, wherein at least about 0.1 ppm of said composition is added to said aqueous system, based on the total weight of the water in said aqueous system.

3. The method of claim 3, wherein a) is a phosphorylated polyol.

4. The method of claim 1, wherein said compound (b) is tolyltriazole or a salt thereof.

5. The method of claim 1, wherein said system contains high dissolved solids.

6. The method of claim 1, wherein said system contains chlorine.

7. The method of claim 6, wherein said system contains high dissolved solids.

8. The method of claim 1, wherein a) is a phosphorylated polyols.

9. The method of claim 8, wherein said system contains high dissolved solids.

10. An aqueous system comprising: a) a polyphosphate selected from the group consisting of phosphate esters of polyhydric alcohols, wherein said esters are of the formula $R—(O—PO_3H_2)_x$ and wherein R is any remaining organic residue of said polyhydric alcohols and X is 2-6; b) a compound selected from the group consisting of alkyl or alkoxy benzotriazoles, tolyltriazole, benzotriazole, and salts thereof, mercaptobenzothiazole, 1-phenyl-5-mercaptotetrazole and salts thereof, wherein the weight wherein the weight ratio of a):b) ranges from about 0.01:100 to about 100:1; and c) water in contact with a copper/nickel alloy.

* * * * *